US009447507B2

(12) United States Patent
Hatch et al.

(10) Patent No.: US 9,447,507 B2
(45) Date of Patent: Sep. 20, 2016

(54) CLEANER COMPOSITION FOR FORMED METAL ARTICLES

(75) Inventors: Andrew M. Hatch, Lake Orion, MI (US); Gary Rochfort, Shelby Township, MI (US); Richard D. Banaszak, Sterling Heights, MI (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/544,070

(22) Filed: Jul. 9, 2012

(65) Prior Publication Data

US 2012/0308727 A1 Dec. 6, 2012

Related U.S. Application Data

(60) Division of application No. 10/763,438, filed on Jan. 23, 2004, now Pat. No. 8,216,992, and a continuation-in-part of application No. 10/350,965, filed on Jan. 23, 2003, now abandoned.

(51) Int. Cl.

| | |
|---|---|
| ***B08B 3/00*** | (2006.01) |
| ***C23G 1/12*** | (2006.01) |
| ***C23G 1/22*** | (2006.01) |
| *C23G 5/032* | (2006.01) |
| *C11D 17/00* | (2006.01) |
| *C11D 1/72* | (2006.01) |
| *C11D 1/66* | (2006.01) |
| *B08B 3/08* | (2006.01) |
| *B08B 3/04* | (2006.01) |
| *B08B 3/02* | (2006.01) |
| *B08B 9/00* | (2006.01) |
| *B08B 9/08* | (2006.01) |
| *B05D 3/10* | (2006.01) |

(52) U.S. Cl.

CPC ..... *C23G 1/125* (2013.01); *C23G 1/22* (2013.01); *B05D 3/10* (2013.01); *B08B 3/00* (2013.01); *B08B 3/02* (2013.01); *B08B 3/04* (2013.01); *B08B 3/08* (2013.01); *B08B 9/00* (2013.01); *B08B 9/08* (2013.01); *B08B 9/0804* (2013.01); *B08B 9/0813* (2013.01); *C11D 1/66* (2013.01); *C11D 1/72* (2013.01); *C11D 17/00* (2013.01); *C23G 5/032* (2013.01); *Y10T 428/12* (2015.01)

(58) Field of Classification Search

CPC ..... C23G 5/032; C11D 17/00; C11D 1/72; C11D 1/66; B08B 3/08; B08B 3/04; B08B 3/00; B08B 3/02; B08B 9/00; B08B 9/08; B08B 9/0804; B08B 9/0813; B05D 3/10

USPC ..... 510/254, 421, 422, 424; 134/22.1, 134/22.14, 22.19, 26, 27, 28, 29, 30, 34, 35, 134/36, 40, 41, 42

See application file for complete search history.

(56) References Cited

U.S. PATENT DOCUMENTS

| | | | |
|---|---|---|---|
| 2,662,814 | A | 12/1953 | Swihart |
| 2,813,816 | A | 11/1957 | Otto |
| 3,431,182 | A | 3/1969 | Frant |
| 3,523,835 | A | 8/1970 | Turner |
| 3,635,826 | A | 1/1972 | Hamilton |
| RE27,662 | E | 6/1973 | Hamilton |
| 3,969,135 | A | 7/1976 | King et al. |
| 4,046,620 | A | 9/1977 | Andrascek et al. |
| 4,116,713 | A | 9/1978 | Otrhalek et al. |
| 4,116,853 | A | 9/1978 | Binns |
| 4,124,407 | A | 11/1978 | Binns |
| 4,184,670 | A | 1/1980 | Rosendahl |
| 4,370,173 | A | 1/1983 | Dollman |
| 4,370,177 | A | 1/1983 | Frelin et al. |
| RE31,198 | E | 4/1983 | Binns |
| 4,668,421 | A | 5/1987 | Dollman |
| 4,728,456 | A | 3/1988 | Yamasoe et al. |
| RE32,661 | E | 5/1988 | Binns |
| 4,762,638 | A | 8/1988 | Dollman et al. |
| 4,859,351 | A | 8/1989 | Awad |
| 4,886,616 | A | 12/1989 | Yamasoe et al. |
| 4,959,105 | A | 9/1990 | Neidiffer et al. |
| 4,960,588 | A | 10/1990 | Hoshowski et al. |

(Continued)

FOREIGN PATENT DOCUMENTS

| | | |
|---|---|---|
| GB | 2121073 A | 12/1983 |
| WO | WO98/49263 | 11/1998 |
| WO | WO00/12661 | 3/2000 |

OTHER PUBLICATIONS

Ridoline 185, Henkel Surface Technologies, 4 pages, Dec. 2, 1997.

(Continued)

*Primary Examiner* — Bibi Carrillo

(74) *Attorney, Agent, or Firm* — Mary K. Cameron

(57) ABSTRACT

The present invention discloses an improved cleaning composition for cleaning metal surfaces such as aluminum and aluminum-containing alloys. The cleaning composition of the present invention comprises water and an ethoxylate of an alcohol having Formula $R_1$—OH wherein $R_1$ is a saturated or unsaturated, straight-chain or branched aliphatic having from 12 to 80 carbon atoms; an inorganic pH adjusting component; and at least one surfactant that is different than the ethoxylate set forth above. The cleaning composition of the present invention also has an average water-break-free percent reduction of less than 50% after 7 days aging of a working composition prepared from the cleaning composition. The present invention also provides a method of cleaning a metal surface with the cleaning composition of the invention.

30 Claims, No Drawings

(56) References Cited

U.S. PATENT DOCUMENTS

| | | | | |
|---|---|---|---|---|
| 4,980,076 | A | | 12/1990 | Tanaka et al. |
| 5,030,323 | A | | 7/1991 | Awad |
| 5,052,421 | A | | 10/1991 | McMillen |
| 5,061,395 | A | | 10/1991 | Meng |
| 5,064,500 | A | | 11/1991 | Awad |
| 5,076,954 | A | | 12/1991 | Loth et al. |
| 5,080,814 | A | | 1/1992 | Awad |
| 5,330,558 | A | | 7/1994 | McCormick et al. |
| 5,336,425 | A | | 8/1994 | Aoki et al. |
| 5,389,199 | A | | 2/1995 | Awad et al. |
| 5,458,698 | A | | 10/1995 | Bershas et al. |
| 5,462,697 | A | | 10/1995 | Yianakopoulos |
| 5,476,601 | A | | 12/1995 | Bershas et al. |
| 5,486,316 | A | * | 1/1996 | Bershas et al. ..... 134/18 |
| 5,584,943 | A | | 12/1996 | Banaszak et al. |
| 5,584,944 | A | | 12/1996 | Bershas et al. |
| 5,705,472 | A | | 1/1998 | Hayes et al. |
| 5,746,837 | A | | 5/1998 | Beck et al. |
| 6,040,280 | A | | 3/2000 | Kelly et al. |
| 6,214,777 | B1 | | 4/2001 | Li et al. |
| 6,328,816 | B1 | | 12/2001 | Carlson et al. |
| 6,559,111 | B2 | | 5/2003 | Colurciello et al. |
| 6,562,142 | B2 | | 5/2003 | Barger et al. |
| 2004/0147422 | A1 | | 7/2004 | Hatch et al. |
| 2007/0184202 | A1 | * | 8/2007 | Rochfort et al. ..... 427/409 |

OTHER PUBLICATIONS

Ridoline 185, Material Health & Safety Data Sheet, Henkel Surface Technologies, 6 pages, Dec. 6, 1997.

International Search Report, International application PCT/US2004/001880, mailed Nov. 10, 2004.

ASTM F22-02, "Standard Test Method for Hydrophobic Surface Films by the Water-Break Test", published Nov. 2002, copyright ASTM International, West Conshohocken, Pennsylvania, USA.

* cited by examiner

CLEANER COMPOSITION FOR FORMED METAL ARTICLES

CROSS-REFERENCE TO RELATED APPLICATIONS

This application is a Divisional of Ser. No. 10/763,438, filed Jan. 23, 2004, now U.S. Pat. No. 8,216,992 and is a CIP of Ser. No. 10/350,965, filed Jan. 23, 2003, now abandoned.

BACKGROUND OF THE INVENTION

1. Field of the Invention

In one aspect, the present invention is related to aqueous acidic compositions for cleaning metal surfaces, and in particular, to aqueous acidic solutions for cleaning aluminum and aluminum alloys.

2. Background Art

Containers comprised of aluminum and alloys thereof are produced in a drawing and forming operation, referred to as drawing and ironing, which results in the deposition of lubricants and forming oils on the surface. In addition, residual aluminum fines, i.e. small particles of aluminum, are deposited on the interior and exterior surfaces of the container during the forming operation. Ordinarily, the exterior surface of the container will have smaller quantities of aluminum fines since during the drawing and ironing step some fines are removed from the exterior surface.

Prior to any processing steps, such as conversion coating and sanitary lacquer deposition, the surfaces of the aluminum containers must be clean and water-break-free so that there are no contaminants which prevent further processing and which render the containers unacceptable for use. "Water-breaks" are understood in the art to be indicative of a contaminated surface.

Acid cleaners have been employed to clean the aluminum surfaces and to remove aluminum fines deposited on the interior walls of aluminum containers. Acid cleaning is ordinarily accomplished at temperatures from 130° F. to 160° F. in order to remove or dissolve the aluminum fines and to remove the lubricants and forming oils so that the surface is rendered water-break-free. The cleanliness of the aluminum surface is measured by the ability of the interior and exterior surfaces of the formed aluminum container to support a continuous film of water that shows no breaks or discontinuities in the film, that is to be water-break-free.

Chromic acid or salts thereof have been utilized in can cleaning technologies to minimize the corrosion of processing equipment by inhibiting the corrosive attack of the acid cleaning composition on the processing equipment. An important shortcoming which cleaners of this kind possess is the inherent toxicity of the hexavalent and trivalent chromium compounds contained therein and the resultant waste disposal problem created by the presence of chromium in the cleaner effluent.

Several prior art metal cleaning compositions contain nonylphenols and rosin ethoxylates. Both of these chemicals have recently come under governmental scrutiny and are regulated in several countries. Nonylphenols are suspected of being endocrine disruptors and rosin ethoxylates are thought to have poor biodegradability. Moreover, high performance cleaners that include rosin ethoxylates tend to be somewhat expensive. Other acidic cleaners are known which omit chromates, nonylphenols, and rosins, but fall short in detergency, stability of the cleaner concentrate and/or are excessively foaming. Accordingly, there exists a need in the prior art for an improved low cost cleaning composition that is stable, safe, low foaming, and has improved biodegradability.

SUMMARY OF THE INVENTION

The present invention overcomes the problems encountered in the prior art by providing in one embodiment, a cleaning composition suitable for cleaning formed metal. The cleaning composition is particularly useful for aluminum and alloy containing aluminum for removing and dissolving aluminum fines and for cleaning lubricating oils from the aluminum. The cleaning composition of the present invention comprises water and:

A) an ethoxylate of an alcohol having Formula $R_1$—OH wherein $R_1$ is a saturated or unsaturated, straight-chain or branched aliphatic having from 12 to 80 carbon atoms;

B) an inorganic pH adjusting component; and

C) at least one surfactant that is different than component A.

The cleaning composition of the present invention has an average water-break-free percent reduction less than 50% after 7 days aging compared to zero days of aging.

The composition of the present invention optionally further comprises one or more of the following:

D) a fluoride component; and

E) anti-foaming agents.

In another embodiment of the present invention, a method for cleaning a metal surface with the cleaning composition of the present invention is provided. This method comprises contacting a metal surface with the cleaning composition of the present invention at a sufficient temperature and for a sufficient time to clean the metal surface. Optionally, the treated metal surface is rinsed one or more times with water and/or deionized water. Furthermore, the treated metal surface may be then contacted with a conversion coating or other types of surface conditioners.

DETAILED DESCRIPTION OF THE PREFERRED EMBODIMENT(S)

Reference will now be made in detail to presently preferred compositions or embodiments and methods of the invention, which constitute the best modes of practicing the invention presently known to the inventors.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counter-ions to produce electrical neutrality for the composition as a whole (any counter-ions thus implicitly specified should preferably be selected from among other constituents explicitly specified in ionic form, to the extent possible; otherwise such counter-ions may be freely selected, except for avoiding counter-ions that act adversely to the objects of the invention); and the term "mole" and its variations may be applied to elemental, ionic, and any other chemical species defined by number and type of atoms present, as well as to compounds with well defined molecules.

The term "working composition" as used herein means a cleaning composition used for the actual treatment of metal surfaces. Typically, the working composition is made from a diluted concentrate composition.

The term "concentrate composition" as used herein means a cleaning composition having components (except water) present in concentrations 5 to 100 times higher than a working composition.

The term "aliphatic" as used herein means a straight or branched, saturated or unsaturated hydrocarbon group. Aliphatic includes alkyl groups, alkenyl groups, and alkynyl groups.

The term "alkyl" as used herein means a saturated straight or branched hydrocarbon group.

The term "alkenyl" as used herein means a straight or branched hydrocarbon group that has at least one double bond.

The term "alkynyl" as used herein means a straight or branched hydrocarbon group that has at least one triple bond.

The term "water-break-free percent" as used herein means the percent of the total surface area which supports a continuous film of water. Water-break-free percent is a measure of the ability of a clean surface to support a continuous break-free sheet water. Typically water-break-free percent is measured for the interior and exterior surfaces for metallic cans.

The term "average water-break-free percent reduction" means the average percent reduction in the measured water-break-free percent for a first set of metal surfaces that have been cleaned with a first working composition made from a cleaning composition at a first time as compared to a second set of metal surfaces substantially similar in surface condition and soil content to the first set of metal surfaces that has been cleaned with a second working composition of the same dilution as the first working composition made from the cleaning composition at a second, later time. The average water-break-free percent reduction provides a measure of the stability of a cleaning composition. For example, if the working cleaning composition were completely stable there would be no reduction in the average water-break-free percent for the second set of metal surfaces.

The term "cloud point" as used herein means the temperature at and above which a fresh working composition of the cleaning composition becomes visibly turbid, that is, translucent, cloudy, or opaque to the unaided human eye.

Typically, metal surfaces are cleaned with cleaning compositions at a temperature slightly above the cloud point of the composition. At the cloud point aqueous compositions become turbid. Above this temperature, such compositions separate into two phases. This separation occurs within a relatively narrow temperature range within which there is a increase in the micelle aggregation and a decrease intermicellar repulsions. For many cleaning compositions detergency is found to be efficient at these temperatures above the cloud point. Moreover, since the cloud points of the prior art compositions are typically below about 120° F., cleaning processes are usually run at temperatures from about 100° F. to about 150° F.

In one embodiment of the present invention, a cleaning composition suitable for cleaning formed metal articles is provided. The cleaning composition of the invention includes both "working compositions" and "concentrate compositions." Moreover, it will be understood by context by those skilled in the art when a working or concentrate composition is described below. The cleaning composition of this embodiment of the present invention comprises water and:

A) an ethoxylate of an alcohol having Formula I $$R_1—OH \quad (I)$$

B) an inorganic pH adjusting component; and

C) at least one surfactant that is different than component A.

The cleaning composition of the present invention is characterized by having an average water-break-free percent reduction of less than 50% after 7 days aging. Preferably, $R_1$ is a saturated or unsaturated, straight-chain or branched aliphatic having from 12 to 80 carbon atoms. In one preferred variation of the present invention $R_1$ is preferably a saturated or unsaturated, straight-chain or branched aliphatic having from 12 to 22 carbon atoms. More preferably in this variation, $R_1$ a saturated or unsaturated, straight-chain or branched aliphatic having from 14 to 22 carbon atoms Most preferably in this variation, $R_1$ is a saturated or unsaturated, straight-chain or branched aliphatic having from 16 to 20 carbon atoms. In another preferred variation of the present invention $R_1$ is a saturated or unsaturated, straight-chain or branched aliphatic having from 23 to 80 carbon atoms. The most preferred formula for $R_1$ includes $CH_3(CH_2)_7—CH=CH(CH_2)_8—$, $CH_3(CH_2)_{17}—$, and/or $CH_3(CH_2)_{13-14}—$. In a particularly preferred embodiment, $R_1$ is an alkenyl having 14 to 22 carbon atoms. In this preferred embodiment, $R_1$ is more preferably an alkenyl having one degree of unsaturation and from 16 to 20 carbon atoms, and most preferably an alkenyl having one degree of unsaturation and 18 carbon atoms. In this embodiment, the most preferred formula for $R_1$ is $CH_3(CH_2)_7—CH=CH(CH_2)_8—$.

The ethoxylate of an alcohol having Formula I (i.e., component A) is a 5 mole to 80 mole ethoxylate. Preferably, the ethoxylate of an alcohol having Formula I is a 5 to 30 mole ethoxylate. More preferably, the ethoxylate of an alcohol having Formula I is a 10 to 25 mole ethoxylate, and most preferably a 20 mole ethoxylate. In another important variation of the invention component A is a 5 to 80 mole ethoxylate and $R_1$ is a saturated or unsaturated, straight-chain or branched alkyl having from 20 to 70 carbon atoms. Moreover the following combinations which characterize component A have also been found useful: component A is a 15 mole ethoxylate and $R_1$ is a saturated or unsaturated, straight-chain or branched alkyl having 13 carbon atoms; component A is a 12 mole ethoxylate and $R_1$ is a saturated or unsaturated, straight-chain or branched alkyl having 14 carbon atoms; component A is a 10 mole ethoxylate and $R_1$ is a saturated or unsaturated, straight-chain or branched alkyl having 16 carbon atoms; and component A is a 10 mole ethoxylate and $R_1$ is a saturated or unsaturated, straight-chain or branched alkyl having 18 carbon atoms. The ethoxylate of an alcohol having Formula I is optionally capped with propylene oxide, chlorine, alkyl, and the like. A particularly preferred ethoxylate is Genapol O-200 commercially available from Clariant Corporation. Genapol O-200 is a 20 mole ethoxylate of oleyl alcohol. Oleyl alcohol is a primary alcohol with the formula $CH_3(CH_2)_7—CH=CH(CH_2)_8OH$. In a working composition, the ethoxylate is preferably present in an amount from about 0.05 gram/liter to about 15 gram/liter of the working composition. More preferably in a working composition, the ethoxylate is present in increasing order of preference in an amount greater than about 0.05 gram/liter, 0.1 gram/liter, 0.15 gram/liter, 0.2 gram/liter, 0.25 gram/liter, and 0.3 gram/liter; and the ethoxylate is present in order of increasing preference in an amount less than about 15 gram/liter, 10 gram/liter, 5 gram/liter, 3 gram/liter, 1 gram/liter, and 0.5 gram/liter of the working composition. Most preferably, in a working solution the ethoxylate is present in increasing order of preference in an amount of about 4 gram/liter, 2 gram/liter, 1.4 gram/liter, 0.7 gram/liter, 0.6 gram/liter, 0.5 gram/liter, and 0.4 gram/liter of the working composition. In a concentrate composition, the concentration of the ethoxylate having Formula I is higher than in a working composition. Typically the concentration will be 5 to 100 times higher in the concentrate composition. Preferably, the ethoxylate is present in a concentrate composition in an amount greater than about 5 gram/liter to about 100 gram/liter of the concentrate composition. More preferably in a concentrate composition, the ethoxylate is present in order of increasing preference in an amount greater than 5 gram/liter, 10 gram/liter, 20 gram/liter, 30 gram/liter, 40 gram/liter, and 50 gram/liter of the concentrate composition; and the ethoxylate is present in order of increasing preference in an amount less than 100 gram/liter, 90 gram/liter, 80 gram/liter, 70 gram/liter, 60 gram/liter of the concentrate composition.

The cleaning composition of the present invention also comprises an inorganic pH adjusting component. The pH adjusting component preferably does not contain fluorine. In one variation of the present invention, an acidic cleaning solution is provided. Accordingly in this variation, the inorganic pH adjusting component is an inorganic acid. Suitable inorganic acids include sulfuric acid, phosphoric acid, nitric acid, or mixtures thereof. The amount of inorganic acid in a working composition will be at least partially determined by the pH ranges set forth below. In a working composition, the inorganic acid is preferably present in a positive amount less than or equal to about 20 gram/liter of the working composition. More preferably in a working composition, the inorganic acid is present in order of increasing preference in an amount greater than about 1 gram/liter, 3 gram/liter, 5 gram/liter, 6 gram/liter, and 7 gram/liter; and the inorganic acid is present in order of increasing preference in an amount less than about 20 gram/liter, 15 gram/liter, 12 grams/liter, 10 grams/liter, and 8 grams/liter of the working composition. In a concentrate composition, the concentration of the inorganic acid is higher than in a working composition. Typically the concentration will be 5 to 100 times higher in the concentrate composition. Preferably, the inorganic acid is present in a concentrate composition in a positive amount less or equal to about 600 gram/liter of the concentrate composition. More preferably in a concentrate composition, the inorganic acid is present in order of increasing preference in an amount greater than 1 gram/liter, 20 gram/liter, 50 gram/liter, 100 gram/liter, 150 gram/liter, 175 gram/liter, 200 gram/liter, 225 gram/liter, 250 gram/liter, 275 gram/liter, 300 gram/liter, and 325 gram/liter of the concentrate composition; and the inorganic acid is present in order of increasing preference in an amount less than 600 gram/liter, 550 gram/liter, 500 gram/liter, 475 gram/liter, 450 gram/liter, 425 gram/liter, and 400 gram/liter of the concentrate composition. In another variation of the present invention, an alkaline cleaning solution is provided. In this variation, the inorganic pH adjusting component is a base. Suitable bases are alkaline bases which include, but are not limited to, sodium hydroxide and potassium hydroxide. In this variation, a sufficient amount of base is added so that a working composition has a pH from about 9 to 13. More preferably, a sufficient amount of base is added so that a working composition has a pH from about 10.5 to about 12.5; and most preferably a sufficient amount so that the pH of a working composition is from about 11 to about 12.

It is within the contemplation of the inventors that an embodiment of the cleaning composition of the present invention may have a pH between 2 and 9. For such embodiments the pH adjusting component may comprise an acid and/or a base. Preferably, an antifoaming agent is included in this embodiment. Any known antifoaming agent that does not interfere with the stability and detergency of the cleaning composition and later processing of the metal is suitable.

The cleaning composition of the present invention also comprises a surfactant that is different than component A. This surfactant may or may not also be described by Formula I. Such materials enhance the cleaning performance by assisting in wetting of the metal surface and in the removal of lubricant and oils. The surfactant to be employed herein can be anionic, cationic, or nonionic. Preferably, the surfactant has a low cloud point to control foam. Examples of surface active agents that can be utilized are Genapol TP-1454 (an alkoxylated alcohol), Tergitol 08 (sodium 2-ethyl hexyl sulfate), Triton DF-16 (a polyethoxylated straight chain alcohol), Polytergent S-505 LF (a modified polyethoxylated straight chain alcohol), Surfonic LF-17 (an alkyl polyethoxylated ether with a propoxylate cap), Plurafac RA-30 (a modified oxyethylated straight chain alcohol), Triton X-102 (an octylphenoxy polyethoxy ethanol), Plurafac D-25 (modified oxyethylated straight chain alcohol), Antarox BL 330 (a modified polyethoxylated straight chain alcohol), and the Pluronic line of copolymers (block-copolymers based on ethylene oxide and propylene oxide) commercially available from BASF Corporation. The surfactant present in the cleaning composition can be a combination of one or more particular surfactants. The preferred surfactants are Surfonic LF-17 commercially available from Huntsman which is a linear polyethoxylated straight chain alcohol having from 12 to 14 carbon atoms and Genapol TP-1454 commercially available from Clariant which is described in product literature as an alkoxylated alcohol.

The total amount of A and C (i.e., the sum of A and C) is generally present in a working composition in an amount from about 0.1 gram/liter to about 30 gram/liter of the cleaning composition. Component C is preferably present in an amount from about 0.05 gram/liter to about 15 gram/liter of the working composition. More preferably in a working composition, component C is present in increasing order of preference in an amount greater than about 0.05 gram/liter, 0.1 gram/liter, 0.15 gram/liter, 0.2 gram/liter, 0.25 gram/liter, and 0.3 gram/liter of the working composition; and component C is present in order of increasing preference in an amount less than about 15 gram/liter, 10 gram/liter, 5 gram/liter, 3 gram/liter, 1 gram/liter, and 0.5 gram/liter of the working composition. Most preferably, component C is present in an amount in increasing order of preference of about 4 gram/liter, 2 gram/liter, 1.4 gram/liter, 0.7 gram/liter, 0.6 gram/liter, 0.5 gram/liter, and 0.4 gram/liter of the working composition. Sufficient amounts of components A in the working composition are included to provide adequate detergency. It is desirable that the proportion of A:C in the working composition be at least in order of increasing preference 1:1, 1.5:1, 2.2:1, 3.6:1, and 7:1. In a concentrate composition, the concentration of component C is higher than in a working composition. Typically the concentration will be 5 to 100 times higher in the concentrate composition.

Preferably, component C is present in a concentrate composition in an amount greater than about 5 gram/liter to about 100 gram/liter of the concentrate composition. More preferably in a concentrate composition, component C is present in order of increasing preference in an amount greater than 5 gram/liter, 10 gram/liter, 20 gram/liter, 30 gram/liter, 40 gram/liter, 50 gram/liter of the concentrate; and component C is present in order of increasing preference in an amount less than 100 gram/liter, 90 gram/liter, 80 gram/liter, 70 gram/liter, 60 gram/liter of the concentrate composition.

The cleaning composition of the invention is further characterized by working compositions having a cloud point greater than conventional cleaners. In certain embodiments of the invention, working compositions have a cloud point greater than about 125° F. More preferably, the working compositions of the present invention have a cloud point greater than in increasing order of preference 140° F., 150° F., 160° F., and 175° F.; and most preferably, the working compositions of the invention have a cloud point greater than about 190° F.

The cleaning composition of the present invention is optionally combinable with a composition that has fluoride. Accordingly, the cleaning composition optionally further comprises a fluoride component (component D). Preferably, the fluoride component is derived from the group consisting of hydrofluoric acid and the total and partial salts thereof.

Such salts include, for example, sodium fluoride and ammonium bifluoride. Although complex fluoride can be employed, greater concentrations of complex fluoride will be necessary to yield desirable amounts of active fluoride, as the hydrolysis of complex fluorides is not as substantial as with the simple fluoride, to liberate the required active fluoride.

In one variation of the present invention as set forth above, the cleaning solution is highly acidic. Typically such a cleaning solution will have a pH below 2.0. The amount of inorganic acid and, if present hydrofluoric acid, can be varied within limits in accordance with the ranges set forth hereinabove so that the pH of the cleaning solution can be adjusted. Preferably, the pH of the cleaning solution is adjusted to from about 1.0 to about 1.8, and optimum results, that is excellent cleaning with minimal etching, are obtained when the pH of the cleaning solution is adjusted to from about 1.2 to about 1.5. However, it is understood that for acidic cleaning solutions, the amount of free acid is a preferred parameter for monitoring the acid content of a solution. Free acidity measures the mineral acid content of a process bath as distinct from the acidity contributed by the hydrolysis of metal ions. It is determined by taking a 10 ml sample of a working composition (or the process bath) and adding either sodium or potassium fluoride to complex any metal ions and prevent the hydrolysis of such metal ions. The sample is titrated to a phenolphthalein end point with 0.1 M NaOH. The result is reported as the number of ml needed to reach the endpoint. Free acidity is used in combination with the fluoride component to maintain the desired rate of metal and inorganic soil removal. The free acidity is monitored and replenished using automatic control equipment. Since the mineral acid replenisher contains the surfactants this measurement is also an indirect measure of the surfactant content. Preferably, the free acid content is in the range of 4 ml to 18 ml. More preferably in a working composition, the free acidity is in the range 7 ml to 12 ml, and most preferably about 9 ml.

The working compositions of the present invention are also characterized by the "total acidity" and the "reaction product." Total acidity measures the acidity due to the mineral acid content of the process bath and that due to hydrolysis of aluminum ions. It is determined by taking a 10 ml sample of the working composition (or process bath) and titrating to a phenolphthalein end point with 0.1M NaOH. The result is reported as the number of ml needed to reach the endpoint. Reaction product is the arithmetic difference between the total acidity and free acidity. The reaction product is roughly proportional to the amount of soluble aluminum in the process bath at the rate of ca. 90 ppm Al per ml of reaction product. It is often regarded as an indirect indicator of a bath's oily soil load. High reaction products are more economical since more chemical remains in the bath. However, if the reaction product is too high it becomes difficult to rinse the cleaner residues from the cans and the build up of oily soils begins to cause water-break problems. Preferably, the reaction product is less than 3.5× the free acidity.

Because of the competing complex-forming-and-dissociating equilibria in which fluoride can participate in a working aqueous liquid composition according to this invention that contains hydrofluoric acid and/or polyvalent cations such as aluminum and titanium that can form complex fluorometallate anions, the preferable concentrations for fluoride in such a composition are specified in terms of "active free fluoride", as measured by means of a fluoride sensitive electrode and associated instrumentation and methods that are known to those skilled in the art. For example, an electrode of this type is described in U.S. Pat. No. 3,431,182 which is hereby incorporated by reference.

"Active free fluoride" as this term is used herein was measured potentiometrically relative to a Standard Solution 120MC commercially available from Henkel Surface Technologies, using a fluoride sensitive electrode commercially available from Orion Instruments. The electrical potential developed between the fluoride sensitive electrode immersed in the Standard Solution at ambient temperature and a standard reference electrode, e.g., a Ag/AgCl electrode, is measured with a high impedance millivolt meter. The same fluoride sensitive electrode is then well rinsed, carefully dried by wiping with absorbent paper, and immersed in a sample of a composition according to this invention at ambient temperature, and the potential developed between this fluoride sensitive electrode and the same standard reference electrode as before is then measured. The value obtained with the fluoride sensitive electrode immersed in the Standard Solution is subtracted from the value obtained with the fluoride sensitive electrode immersed in the composition according to the invention to yield the values in millivolt(s) (hereinafter often abbreviated "my" or "mV") by which the Active Free Fluoride of compositions according to the invention is measured.

Preferred Active Free Fluoride values for working compositions according to the invention correspond to millivolt values that are positive with respect to the standard solution. Therefore, more negative millivolt values correspond to stronger fluoride activities and more positive millivolt values to weaker fluoride activities. In a working composition according to the invention, the mV value preferably from about 5 mV to about 30 mV. More preferably, the mV value is from about 10 to 20 mV; and most preferably about 15 mV. As the cleaning solution is used, aluminum is dissolved off the surface being treated at a specific rate. In general, cleaning solutions of the present invention will have operating characteristics such that initially (i.e., at make-up) the aluminum dissolution rate is from about 8 to about 25 milligrams per square foot (0.009 to 0.027 mg/cm$^2$) of aluminum surface treated. It has been observed that best results, with minimal etch of the surface, are obtained when the aluminum dissolution rate is from 9 to 20 milligrams per square foot (0.01 to 0.022 mg/cm$^2$) of aluminum surface treated. This dissolution rate occurs at make-up of a cleaning solution having from about 0.005 to about 0.1 grams/liter of hydrofluoric acid. By establishing a reference potential point with a potentiometric type electrode at make-up of the cleaning solution, and by recording the potential measurements as metal surfaces are processed and cleaned, the aluminum dissolution rate is maintained within the preferred range by additions of active fluoride, preferably as hydrofluoric acid. So, the potentiometric electrode is used as a guideline for determining when to adjust the amounts of active fluoride in solution, and also to maintain sufficient active fluoride therein to affect a desirable aluminum dissolution rate.

The active fluoride in the cleaning solution aids in the removal of aluminum fines on the metal substrate which have formed during the forming operation. A surprising aspect of this invention is that the cleaning process can be effected when the amount of hydrofluoric acid present in the solution, is as low as 0.005 grams/liter. The preferred amount of hydrofluoric acid results in the presence of sufficient active fluoride to accomplish removal of the aluminum fines without vigorous attack of the underlying aluminum surface. Of course, should the active fluoride be depleted in the cleaning solution, preferably it can be replenished by addition of hydrofluoric acid.

It is normally preferred that compositions according to the invention as defined above should be substantially free from many ingredients used in compositions for similar purposes in the prior art. Such ingredients include hexavalent chromium; trivalent chromium; ferricyanide; ferrocyanide; ethoxylated rosins; and nonylphenols. Preferably, the compositions of the present invention less than about 1.0% of such ingredients. More preferably, the compositions of the present invention include less than about 0.35% of such ingredients, and most preferably less than about 0.001% of such ingredients.

In another embodiment of the present invention, a cleaning composition for formed metal articles is provided. The cleaning composition of this embodiment comprises water and:

A) an ethoxylate of an alcohol having Formula I:

$$R_1—OH \qquad I$$

wherein $R_1$ is a saturated or unsaturated, straight-chain or branched alkyl having from 12 to 80 carbon atoms;

B) an inorganic pH adjusting component; and

C) at least one surfactant that is different than component A.

In this embodiment, the cleaning composition is capable of cleaning an exterior wall of an aluminum can at a temperature that is less than the cloud point of the cleaning composition such that the percent of total surface area of the exterior wall which supports a continuous film of water is greater than 50% after the aluminum can is cleaned with the cleaning composition (and rinsed). The selection of $R_1$ is the same as that set forth above. Moreover, the reaction conditions, ranges and choices for the ethoxylate, inorganic pH adjusting component, and the at least one surfactant that is different than component A are also the same as those set forth above.

In another embodiment of the present invention, a cleaning composition for formed metal articles is provided. The cleaning composition of this embodiment comprises water and:

A) an ethoxylate of an alcohol having Formula I:

$$R_1—OH \qquad I$$

wherein $R_1$ is a saturated or unsaturated, straight-chain or branched alkyl having from 12 to 80 carbon atoms and the ethoxylate is a 14 mole or greater ethoxylate;

B) an inorganic pH adjusting component; and

C) at least one surfactant that is different than component A.

Moreover, the reaction conditions, ranges and choices for the ethoxylate, inorganic pH adjusting component, and the at least one surfactant that is different than component A are also the same as those set forth above. The selection of $R_1$ is the same as that set forth above. Finally, the selection of the ethoxylate having Formula I is the same as that set forth above except that the ethoxylate is a 14 mole or greater ethoxylate. Preferably, the ethoxylate of an alcohol having Formula I is a 14 to 30 mole ethoxylate. More preferably, the ethoxylate of an alcohol having Formula I is a 10 to 25 mole ethoxylate, and most preferably a 20 mole ethoxylate In another embodiment of the present invention, a cleaning composition for formed metal articles is provided. The cleaning composition of this embodiment comprises water and:

A) an ethoxylate of an alcohol having Formula I:

$$R_1—OH \qquad I$$

wherein $R_1$ is a saturated or unsaturated, straight-chain or branched alkyl having from 14 to 80 carbon atoms and the ethoxylate is a 10 mole or greater ethoxylate;

B) an inorganic pH adjusting component; and

C) at least one surfactant that is different than component A.

The ethoxylate is with increasing preference a 14, 15, 20, 30, or 40 mole ethoxylate. The maximum number of ethoxylates is typically determined by the foam causing characteristics of component A. Too high a number of ethoxylates results in too much foaming. Moreover, the reaction conditions, ranges and choices for the ethoxylate, inorganic pH adjusting component, and the at least one surfactant that is different than component A are also the same as those set forth above. The selection of $R_1$ is the same as that set forth above except that $R_1$ is a saturated or unsaturated, straight-chain or branched alkyl having from 14 to 80 carbon atoms. In one variation of this embodiment, $R_1$ is a saturated or unsaturated, straight-chain or branched alkyl having from 14 to 22 carbon atoms. More preferably in this variation, $R_1$ is a saturated or unsaturated, straight-chain or branched aliphatic having from 14 to 22 carbon atoms Most preferably in this variation, $R_1$ is a saturated or unsaturated, straight-chain or branched aliphatic having from 16 to 20 carbon atoms. In another preferred variation of this embodiment $R_1$ is a saturated or unsaturated, straight-chain or branched aliphatic having from 23 to 80 carbon atoms. In yet another preferred variation $R_1$ is a mixture of straight-chain and branched alkyl having from 14 to 50 carbon atoms. Similarly, the selection of the ethoxylate having Formula I is the same as that set forth above except that the ethoxylate is a 10 mole or greater ethoxylate. More preferably, the ethoxylate of an alcohol having Formula I is a 10 to 30 mole ethoxylate. More preferably, the ethoxylate of an alcohol having Formula I is a 10 to 25 mole ethoxylate, and most preferably a 20 mole ethoxylate.

Another embodiment of the invention is a process of cleaning a metal with a composition as described above. In this embodiment of the invention, the metal to be cleaned is contacted with the compositions of the present invention. The metal surface should be cleaned employing techniques that result in a completely water-break-free surface. The cleaning solution can be applied to the aluminum surface utilizing any of the contacting techniques known to the art. Preferably, application will be effected by conventional spray or immersion methods. Preferably, the temperature at which the metal is contacted is from about 60° F. to about 160° F. More preferably, the contacting temperature is from about 90° F. to about 150° F., and most preferably from about 120° F. to 150° F. This is a distinct advantage of the present invention over some prior art processes, as the low operating temperatures with good cleaning results prevents accelerated corrosion and attack of processing equipment. The time of contact between a working composition according to the invention and a metal substrate to be treated preferably is from about 1 to about 1800 seconds. More preferably, the time of contact is from about 3 seconds to about 180 seconds, and most preferably from about 30 to 120 seconds. Independently, it is preferred that the metal surface thus treated be subsequently rinsed with water in one or more stages before being dried. Usually, one or more aqueous rinses are applied to the cans following the cleaning step and prior to oven drying, decoration, and application of sanitary lacquers. In one embodiment of the present invention the rinsing process would consist of one to three tap water rinses and a final rinse with deionized water. For reasons of economy and efficiency, these may include the use of recirculated rinses in addition to virgin rinses, with or without adjustment of the rinses pH or conductivity. These, and numerous other rinse schemes are well known to those skilled in the art.

In another embodiment, cans that have been cleaned with the present invention may be rinsed and then subjected to any of several subsequent surface modifying treatments, separately or in combination, with the intention of imparting certain desirable characteristics to the cans surface. For example, cans cleaned with the present invention may be rinsed with recirculating and/or virgin water followed by treatment with a "conversion coating" to improve their stain resistance or to improve the adhesion of subsequently applied decorative coatings or sanitary lacquers, or to reduce the static coefficient of friction of the cans. Examples of these surface-modifying treatments are described in U.S. Pat. Nos. 4,184,670; 4,370,177; 5,030,323; and 5,476,601. The entire disclosure of each of these patents is hereby incorporated by reference. Typically, the conversion coating is applied to the cans in Stage 4 of six or seven stage power spray washers and is followed by additional recirculating and virgin tap water and deionized water rinses prior to oven drying.

In still another embodiment of the invention described herein, the cans may be cleaned with the present invention and rinsed as previously described with a surface modifying agent dissolved in the final deionized water rinse or in a separate application stage following the virgin deionized water rinse. Some representative "final-rinse" treatments of this kind are described in U.S. Pat. Nos. 5,080,814 and 6,040,280. The entire disclosure of each of these patents is hereby incorporated by reference.

In yet another embodiment of the invention described herein, it is possible to combine the use of the present invention with the "conversion coating" surface treatments and with the "final-rinse" surface treatments described above.

In another embodiment of the present invention, a concentrated cleaning composition is provided. This concentrated cleaning composition is combined together with water to form the working composition as set forth above. The concentrated cleaning composition includes each of the components disclosed above for a working composition. These components are water and:

A) an ethoxylate of an alcohol having Formula $R_1$—OH wherein $R_1$ is a saturated or unsaturated, straight-chain or branched aliphatic having from 12 to 22 carbon atoms;

B) an inorganic pH adjusting compound that does not contain fluorine;

C) at least one surfactant that is different than component A.; and optionally,

D) a fluoride component; and

E) anti-foaming agents.

However, components A, B, C are in concentrations that are higher than for a working composition. Preferably, these components are in amounts that are from about 5 to 100 times higher than for a working composition.

The practice of this invention may be further appreciated by consideration of the following, non-limiting, working examples.

Test Methods

1. Foaming

Foaming characteristics of the cleaning composition were determined as follows. A concentrate is diluted to a sufficient extent to form a 0.06% working composition. Aluminum sulfate and ammonium bifluoride are added to build artificial reaction product corresponding to the same dilution and the solution's pH is adjusted to pH 5 with aqueous ammonia. One liter of the solution is placed in a 4 liter graduated cylinder and then sparged at 86° F. with nitrogen at ½ liter per minute while monitoring the total fluid volume (foam+liquid) at one minute intervals for a period of 10 min. or until the foam reaches the top of the graduated cylinder. The foam build rate is characterized by the initial foam volume which is defined as the foam volume at 4 minutes. The foam is further characterized by the persistent foam volume which is the foam volume at 10 minutes after the nitrogen sparge is turned off.

2. Water-Break-Free Percent

Water-break-free percent is a measure of the ability of a clean surface to support a continuous break-free sheet of water. Water-Break percentages were measured by visual estimation by an experienced rater as the percent of the total surface area which supports a continuous film of water. The present water-break-free percent test is a variation of ASTM F22-02, which is hereby incorporated by reference, in which a surface is judged to be free of hydrophobic contaminants if a draining water layer remains as a thin continuous film over a test metal surface. The present water-break-free percent test is designed to quantify the results of the qualitative (pass/fail) ASTM test. The present test indicates the cleaners' effectiveness by quantitative assessment of the water-break-free area on the metal surface.

Example 1

Concentrated cleaning solutions were prepared according to the compositions provided in Table 1. Each component is given in a weight percentage of the total concentrate composition. Concentrates A, B, C, and D correspond to the cleaning solutions of the present invention. Concentrate M corresponds to a commercially available high performance cleaner. Working compositions of concentrate M is characterized as having a cloud point of 39° C. (102° F.) and concentrate A as having a cloud point of 64° C. (147° F.). Working compositions for each concentrate were prepared by adding 12.82 grams of concentrate to a liter of water (referred to as compositions A through M.) The working compositions further included enough hydrofluoric acid to give a fluoride reading of about 15 mV by the method described above. The working compositions were further characterized by a free acid content of about 9 ml, a total acidity of about 22, and a reaction product of about 13. To the working compositions were added 3500 ppm metal working soils typically found as contaminants in industrial can washers which comprised commonly available metal working fluids and hydraulic oil.

Aluminum cans were cleaned with working compositions of the compositions in Table 1 according to the methods disclosed in U.S. Pat. No. 6,040,280, column 10, lines 34 to 46, which is hereby incorporated by reference subject to the following variations: any modifications explicitly revealed in the present application take precedence, the conversion coating step in stage #4 of Table 1 of the referenced patent is omitted, the lubricant and surface conditioner step in stage #7 of Table 1 of the referenced patent is omitted. The aluminum cans used in the tests of the present application were obtained from an industrial can manufacturing plant.

TABLE 1

| Weight percentages for cleaning concentrates | | | | | | | | | | | | | |
|---|---|---|---|---|---|---|---|---|---|---|---|---|---|
| Component | A | B | C | D | E | F | G | H | I | J | K | L | M |
| Water | 55.0 | 55.0 | 55.0 | 57.0 | 45.0 | 43.52 | 58.5 | 50.5 | 50.5 | 50.5 | 50.5 | 54.8 | 52.0 |
| 93% $H_2SO_4$ | 37.0 | 37.0 | 37.0 | 37.0 | 45.0 | 45.58 | 34.5 | 37.0 | 37.0 | 37.0 | 37.0 | 37.2 | 37.0 |
| Triton DF-16 | | | | | 9.3 | 10.12 | | | | | | | |
| Plurafac D-25 | | | | | 0.7 | 0.78 | 3.0 | | 6.25 | | | | |
| Genapol TP-1454 | | 4.0 | 4.0 | 2.4 | | | | | | | | | |
| Chemax AR-497 | | | | | | | | 6.25 | 6.25 | 6.25 | 6.25 | | 5.5 |
| Triton CF-10 | | | | | | | | 6.25 | | | | | |
| Antarox LF-330 | | | | | | | | | | 6.25 | | | |
| Trycol 6720 | | | | | | | | | | | 6.25 | | |
| Tergitol NP-9 | | | | | | | | | | | | 4.665 | |
| Surfonic LF-17 | 4.0 | | | | | | | | | | | 3.335 | 5.5 |
| Plurafac RA-30 | | | | | | | 4.0 | | | | | | |
| Genapol O-200 | 4.0 | 4.0 | | | | | | | | | | | |
| Tomadol 45/13 | | | 4.0 | 3.56 | | | | | | | | | |

Table 2 provides the cloud points of the working compositions made from concentrates A, B, C, and D.

TABLE 2

| Cloud points of the compositions of the present invention. | | |
|---|---|---|
| Composition | Cloud Point, ° F. 1% In Deionized Water | Cloud Point, ° C. 1% In Deionized Water |
| A | 147 | 64 |
| B | 204 | 96 |
| C | 205 | 96 |
| D | 208 | 98 |

The effectiveness of the cleaning solutions was evaluated by subjecting aluminum test cans to an aqueous sulfuric acid prewash for about 30 seconds at about 140° F., wherein the prewash had a pH of about 2.0. The test cans were then contacted with the working compositions for about 60 seconds at a temperature of about 145° F. The test cans were then contacted with a more dilute concentration of the working compositions (50 ml cleaner bath per liter of working composition) at ambient temperatures for 30 seconds. This more dilute working composition mimics the resulting drag-through in commercial can washers. The cans were next rinsed with tap water for about 30 seconds and then deionized water for about 90 seconds. The cans were evaluated as follows.

The aluminum surfaces were tested for water-break following cleaning. Table 3 provides the average water-break-free percentages on the exterior surface for four test cans. Water-break-free percentage is the percentage of water-break-free surface. Table 4 provides the average water-break-free percentages on the interior surface for 4 test cans. The values for a working composition prepared from concentrates A-M are provided for freshly prepared concentrates (day 0) and for concentrates that have been aged for 7 days at 140° F. The working compositions corresponding to concentrates A, B, C, D, and I are observed to have break water performance superior to that of compositions E-H and J-M.

TABLE 3

| Average Water-Break-Free percentages for the exterior wall surfaces as prepared. | | |
|---|---|---|
| Composition | Day 0 (as prepared) | Day 7 |
| A | 100 | 98 |
| B | 100 | 100 |
| C | 91 | 70 |
| D | 91 | 76 |
| E | 20 | 20 |
| F | 4 | 1 |
| G | 54 | 31 |
| H | 51 | 43 |
| I | 94 | 89 |
| J | 56 | 31 |
| K | 43 | 20 |
| L | 35 | 19 |
| M | 73 | 39 |

TABLE 4

| Average Water-Break-Free percentages for the interior wall surfaces as prepared. | | |
|---|---|---|
| Composition | Day 0 (as prepared) | Day 7 |
| A | 100 | 100 |
| B | 100 | 100 |
| C | 100 | 100 |
| D | 100 | 100 |
| E | 100 | 100 |
| F | 100 | 96 |
| G | 100 | 100 |
| H | 100 | 100 |
| I | 100 | 100 |
| J | 100 | 100 |
| K | 100 | 100 |
| L | 100 | 100 |
| M | 100 | 100 |

Tables 5 and 6 provide foaming characteristics of working compositions formed from the fresh and aged compositions A-M of Table 4. Despite adequate exterior water-break-free performance, the composition of concentrate I provides unacceptable foam characteristics. Although composition A of the present invention foams more than the compositions of concentrates B, C, and D, the foam is observed to rapidly dissipate as evident from Table 6. Moreover, little increase in foaming is observed after seven days of aging. Table 6 gives the foam volume 10 minutes after a gas sparge is stopped. Moreover, the foam characteristics of the compositions A, B, C, and D of the present invention are not unacceptably high.

TABLE 5

| Volume of foam in ml produced by a 4 minute gas sparge as prepared. | | |
|---|---|---|
| Composition | Day 0 (as prepared) | Day 7 |
| A | 2050 | 2050 |
| B | 200 | 250 |
| C | 250 | 250 |
| D | 250 | 300 |
| E | 850 | 1350 |
| F | 1350 | 1650 |
| G | 2200 | 2150 |
| H | 600 | 1350 |
| I | 2350 | 2050 |
| J | 600 | 450 |
| K | 250 | 350 |
| L | 2350 | 2250 |
| M | 500 | 300 |

TABLE 6

| Volume of foam in ml remaining after a 4 minute gas sparge and 10 minute decay | | |
|---|---|---|
| Composition | Day 0 (as prepared) | Day 7 |
| A | 0 | 0 |
| B | 0 | 0 |
| C | 0 | 0 |
| D | 0 | 0 |
| E | 0 | 0 |
| F | 0 | 0 |
| G | 0 | 0 |
| H | 0 | 200 |
| I | 200 | 0 |
| J | 0 | 0 |
| K | 0 | 0 |

TABLE 6-continued

| Volume of foam in ml remaining after a 4 minute gas sparge and 10 minute decay | | |
|---|---|---|
| Composition | Day 0 (as prepared) | Day 7 |
| L | 1050 | 2100 |
| M | 0 | 0 |

Table 7 provides average water-break-free percentages for the exterior wall surfaces of aluminum cans cleaned with working composition of a cleaning composition that includes an ethoxylate having Formula I with $R_1$ having from 10 to 50 carbon atoms and 5 to 40/41 ethoxylates. The number of carbon atoms, the number of ethoxylates, and the structures in Table 7 are nominal descriptions of those components provided by the respective manufacturers. It is recognized by those skilled in the art that ethoxylated alcohols typically are mixtures of products comprising a range of carbon atom numbers, degree of ethoxylation, and linear-branched ratio. It is also known in the art to identify such substances by the average number of carbon atoms, average number of ethoxylates, or by the range of carbon atoms in the major components. Moreover, the following combinations were also found to provide satisfactory or better water-break-free percents: component A is a 15 mole ethoxylate and $R_1$ is a branched alkyl having 13 carbon atoms; component A is a 11-12 mole ethoxylate and $R_1$ is a 85% linear alkyl having 12-15 carbon atoms; component A is a 10 mole ethoxylate and $R_1$ is a linear alkyl having 16 carbon atoms; and component A is a 10 mole ethoxylate and $R_1$ is a linear alkyl having 18 carbon atoms, component A is a 12-13 mole ethoxylate and $R_1$ is an 85% linear alkyl having 14-15 carbon atoms. Without being held to a single particular theory, is believed that a mixture of linear and branched $R_1$ is desirable. The data reveals that for all carbon lengths considered ethoxylates of 20 or more all exhibited superior water-break-free percent.

TABLE 7

| Average Water-Break-Free percentages for exterior wall surfaces for variation combination of number of carbon atoms in the alcohol and for number of ethoxylates. | | | |
|---|---|---|---|
| Carbon atoms in alcohol | Number of ethoxylates | Type of alcohol | Water-Break-Free % |
| 10 | 8 | 85% linear, 15% branched | 2 |
| 11 | 7 | 85% linear, 15% branched | 0 |
| 11 | 9 | 85% linear, 15% branched | 2 |
| 11 | 11 | 85% linear, 15% branched | 1 |
| 11 | 8 | linear | 4 |
| 12 | 22 | linear | 100 |
| 13 | 7 | 85% linear, 15% branched | 8 |
| 13 | 5 | branched | 37 |
| 13 | 8 | branched | 0 |
| 13 | 9 | branched | 0 |
| 13 | 12 | branched | 1 |
| 13 | 15 | branched | 26 |
| 13 | 16 | branched | 11 |
| 13 | 20 | branched | 41 |
| 13 | 30/31 | branched | 67 |
| 13 | 40/41 | branched | 84 |
| 14 | 7 | 85% linear, 15% branched | 8 |

TABLE 7-continued

Average Water-Break-Free percentages for exterior wall surfaces for variation combination of number of carbon atoms in the alcohol and for number of ethoxylates.

| Carbon atoms in alcohol | Number of ethoxylates | Type of alcohol | Water-Break-Free % |
|---|---|---|---|
| 14 | 9 | 85% linear, 15% branched | 16 |
| 14 | 12 | 85% linear, 15% branched | 53 |
| 14 | 6 | linear | 1 |
| 14 | 7 | linear | 5 |
| 14 | 8 | linear | 0 |
| 14 | 9 | linear | 0 |
| 14 | 12 | linear | 15 |
| 14-15 | 12-13 | 85% linear, 15% branched | 88 |
| 16 | 10 | linear | 95 |
| 16 | 20 | linear | 100 |
| 18 | 10 | linear | 52 |
| 18 | 20 | linear | 100 |
| 25 | 30/31 | linear | 96 |
| 50 | 16 | linear | 11 |

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of cleaning an aluminum or aluminum alloy container, the method comprising:

a) placing an aluminum or aluminum alloy container in an industrial can washer;

b) cleaning said container with a cleaning composition having a pH of less than 2 and maintaining the cleaning composition temperature above the cleaning composition cloud point for a sufficient time to clean a metal surface of the container, the cleaning composition comprising water and components:

A) an ethoxylate of an alcohol, said alcohol having Formula I:

$$R_1—OH \quad (I)$$

wherein $R_1$ is a saturated or unsaturated, straight-chain or branched alkyl having from 12 to 18 carbon atoms having a 6 moles to 16 moles ethoxylation present in an amount of about 0.05 g/l to about 15 g/l;

B) an inorganic pH adjusting component; and

C) at least one surfactant that is different than component A present in an amount of about 0.05 g/l to about 15 g/l; and c) after cleaning step b)

c1) rinsing the aluminum or aluminum alloy container with tap water thereby removing the cleaning composition from the container to provide a clean container.

2. The method of claim 1 wherein the metal surface is contacted with the cleaning composition for about 1 second to about 1800 seconds and the aluminum or aluminum alloy container comprises an aluminum can.

3. The method of claim 1 wherein the metal surface is contacted with the cleaning composition at a temperature from about 60° F. to about 180° F.

4. The method of claim 1 further comprising:

c2) rinsing the aluminum or aluminum alloy container after c1) with a surface modifying agent dissolved in a final deionized water rinse or in a separate application stage following a virgin deionized water rinse; and d) drying the aluminum or aluminum alloy container.

5. The method of claim 1 further comprising contacting the metal surface with a conversion coating.

6. The method of claim 1 further comprising contacting the metal surface with a surface modifying agent.

7. The method of claim 1 wherein after step b), greater than 50% of total surface area of an exterior wall of the aluminum container supports a continuous film of water.

8. The method of claim 1 wherein $R_1$ is a saturated or unsaturated, straight-chain or branched alkyl having from 12 to 16 carbon atoms.

9. The method of claim 1 wherein $R_1$ is a saturated or unsaturated, straight-chain or branched alkyl having from 16 to 18 carbon atoms.

10. The method of claim 1 wherein $R_1$ is a mixture of straight-chain and branched alkyl having from 14 to 18 carbon atoms.

11. The method of claim 1 wherein R1 is $CH_3(CH_2)_{17}$—, $CH_3(CH_2)_{13}$ or $CH_3(CH_2)_{14}$—.

12. The method of claim 1 wherein component A is a 7 to 16 mole ethoxylate.

13. The method of claim 1 wherein component A is a 7 to 16 mole ethoxylate and $R_1$ is a saturated or unsaturated, straight-chain or branched alkyl having from 12 to 16 carbon atoms.

14. The method of claim 1 wherein:

Component A is a 15 mole ethoxylate and $R_1$ is a saturated or unsaturated, straight-chain or branched alkyl having 13 carbon atoms; or Component A is a 11 to 12 mole ethoxylate and $R_1$ is a saturated or unsaturated, straight-chain or branched alkyl having 12 to 15 carbon atoms; or Component A is a 10 mole ethoxylate and $R_1$ is a saturated or unsaturated, straight-chain or branched alkyl having 16 carbon atoms; or Component A is a 10 mole ethoxylate and $R_1$ is a saturated or unsaturated, straight-chain or branched alkyl having 18 carbon atoms; or Component A is a 12 to 13 mole ethoxylate and $R_1$ is an 85% linear alkyl having 14 to 15 carbon atoms.

15. The method of claim 1 wherein $R_1$ is a saturated or unsaturated, straight-chain or branched alkyl having from 14 to 18 carbon atoms and the ethoxylate is a 10 to 16 mole ethoxylate.

16. The method of claim 1 wherein Component A) and Component C) are present in amounts resulting in a ratio of Component A) to Component C) of at least 1:1.

17. The method of claim 3 wherein the cleaning composition has a cloud point greater than about 125° F.

18. The method of claim 15 wherein Component C) comprises a surfactant selected from the group consisting of propoxylated alcohols, sodium 2-ethyl hexyl sulfate, alkyl polyethoxylated ethers with a propoxylate cap, octylphenoxy polyethoxy ethanol, block-copolymers based on ethylene oxide and propylene oxide, and mixtures thereof.

19. The method of claim 15 wherein

Component A) is present in an amount from about 0.05 gram/liter to about 10 gram/liter of the cleaning composition;

Component B) comprises an inorganic acid present in a positive amount less than or equal to about 20 gram/liter of the cleaning composition; and Component C) is present in an amount from about 0.05 gram/liter to about 10 gram/liter of the cleaning composition.

20. A method of cleaning a metal surface, the method comprising:

a) contacting an aluminum or aluminum alloy containing metal surface with a cleaning composition at a sufficient temperature above the cloud point to result in micelle aggregation and for a sufficient time to clean metal working soils from the metal surface, the cleaning composition comprising water and components:

A) an ethoxylate of an alcohol, said alcohol having Formula I $$R_1—OH \quad \text{I}$$

wherein $R_1$ is a saturated or unsaturated, straight-chain or branched alkyl having from 10 to 25 carbon atoms having a 5 moles or greater ethoxylation; Component A being present in an amount of about 0.05 g/l to about 3 g/l;

B) an inorganic pH adjusting component present in an amount sufficient to provide the cleaning composition with a pH of less than 2; and C) at least one surfactant that is different than Component A); present in an amount of about 0.05 g/l to about 3 g/l; and b) thereafter rinsing the metal surface with tap water thereby removing remaining cleaning composition from the metal surface to render the metal surface water-break-free.

21. The method of claim 20 wherein the contacting step takes place in a power spray washer and the metal surface is contacted with the cleaning composition for about 1 second to about 1800 seconds, and wherein the aluminum or aluminum alloy containing metal surface is an aluminum container and the metal surface is contacted with the cleaning composition at a temperature from about 60° F. to about 180° F.

22. The method of claim 20 wherein prior to step a) the aluminum or aluminum alloy containing metal surface is subjected to a drawing and/or forming operation and the metal working soils comprise lubricants and forming oils.

23. The method of claim 20 further comprising:

c) drying the metal surface; and d) applying at least one decorative coating or sanitary lacquer.

24. The method of claim 20 further comprising contacting the metal surface with a conversion coating.

25. The method of claim 20 wherein $R_1$ is a saturated or unsaturated, straight-chain or branched alkyl having from 10 to 16 carbon atoms.

26. The method of claim 20 wherein $R_1$ is a saturated alkyl having from 11 to 25 carbon atoms.

27. The method of claim 20 wherein $R_1$ is a mixture of straight-chain and branched alkyl having from 12 to 25 carbon atoms and the ethoxylation is 10 moles or greater.

28. The method of claim 20 wherein Component C) comprises a surfactant selected from the group consisting of propoxylated alcohols, sodium 2-ethyl hexyl sulfate, alkyl polyethoxylated ethers with a propoxylate cap, octylphenoxy polyethoxy ethanol, block-copolymers based on ethylene oxide and propylene oxide, and mixtures thereof.

29. The method of claim 23 further comprising a step of contacting the metal surface with a surface modifying agent after step b).

30. A method of cleaning an aluminum or aluminum alloy container, the method comprising:

a) placing an aluminum or aluminum alloy container in an industrial can washer;

b) cleaning metal working soils from said container by spraying in the industrial can washer with a cleaning composition, having a pH of less than 2, comprising water and components:

A) an ethoxylate of an alcohol, said alcohol having Formula I:

$$R_1—OH \quad \text{(I)}$$

wherein $R_1$ is a saturated or unsaturated, straight-chain or branched alkyl having from 10 to 16 carbon atoms having a 7 moles to 20 moles ethoxylation present in an amount of about 0.05 g/l to about 3 g/l;

B) an inorganic pH adjusting component comprising 1 g/l to 20 g/l sulfuric acid; and C) at least one surfactant that is different than component A present in an amount of about 0.05 g/l to about 3 g/l; and c) immediately after step b) rinsing the cleaned container with water to rinse cleaner residues from the container to render the container water-break-free;

wherein C) is selected from an alkoxylated alcohol different from the ethoxylate of an alcohol (A), sodium 2-ethylhexyl sulfate, an alkyl polyethoxylated ether with a propoxylate cap, an octylphenoxy polyethoxy ethanol, and block copolymers based on ethylene oxide and propylene oxide.

* * * * *